US006540181B1

(12) United States Patent
Yang et al.

(10) Patent No.: US 6,540,181 B1
(45) Date of Patent: Apr. 1, 2003

(54) GOLF BAG SUPPORT APPARATUS

(75) Inventors: Chih-Hsiang Yang, Kin Bay (HK); Ching-Piao Lin, Kin Bay (HK)

(73) Assignee: Homewell Enterprises Limited, Kln Bay (HK)

( * ) Notice: Subject to any disclaimer, the term of this patent is extended or adjusted under 35 U.S.C. 154(b) by 0 days.

(21) Appl. No.: 09/976,145

(22) Filed: Oct. 15, 2001

(51) Int. Cl.[7] ..... A63B 55/00
(52) U.S. Cl. ..... 248/96; 206/315.3
(58) Field of Search ..... 248/96; 206/315.3, 206/315.7

(56) References Cited

U.S. PATENT DOCUMENTS 5,339,951 A * 8/1994 Chen ..... 206/315.7
5,762,189 A * 6/1998 Reimers ..... 206/315.7
5,927,489 A * 7/1999 Carswell ..... 206/315.1
5,762,189 A * 9/1999 Reimers ..... 206/315.7
6,010,101 A * 1/2000 Stein et al. ..... 248/96
6,098,797 A * 8/2000 Han ..... 206/315.7
6,220,433 B1 * 4/2001 Kang ..... 206/315.1
6,298,988 B1 * 10/2001 Wen-Chien ..... 206/315.1
6,311,937 B1 * 11/2001 Han ..... 248/96
6,315,117 B1 * 11/2001 Han ..... 206/315.7
6,386,362 B1 * 5/2002 Cheng ..... 206/315.3

* cited by examiner

*Primary Examiner*—Ramon O. Ramirez
*Assistant Examiner*—Kofi Schulterbrandt
(74) *Attorney, Agent, or Firm*—Troxell Law Office PLLC

(57) ABSTRACT

The present invention relates to a golf bag support apparatus, wherein, a pair of support rods extending downward are symmetrically disposed on the opening side rim of the said golf bag; a pair of steel wires are symmetrically disposed at one end of the opening; the said steel wires go through an opening extend downward to the bottom edge of the golf bag thereof, go through another opening of the said bottom edge and protrude the golf bag; a positioning element is disposed on the circumferential rim of the said opening; a support body is pivotally disposed at one distal end of the said steel wires penetrated the bottom edge of the golf bag; the specialty of not easily slipping of the said steel wires pressing against onto the positioning element enables the said support rods and the support body to position respectively and stably at an expanded angle.

8 Claims, 4 Drawing Sheets

GOLF BAG SUPPORT APPARATUS

BACKGROUND OF THE INVENTION

1) Field of the Invention

The present invention relates to a golf bag support apparatus, more specifically, a pair of support rods of a golf bag are expanded to stand on a plane; through the specialty of not easily slipping of a pair of steel wires pressing against onto the a positioning element, the said support rods and the support body position respectively and stably at an expanded angle, thereby make the golf bag stand on the said plane without sliding down.

2) Description of the Prior Art

Accordingly, the support apparatus of a traditional golf bag, referring to FIG. 7, usually has a longitudinal fixed body (11) disposed on the surface of a golf bag (1); a pivot joint block (12) is disposed at the upper end of the said fixed body (11); a pair of support rods (13) extending downward are symmetrically and pivotally disposed on two respective sides of the said pivot joint block (12); an elastic element (14) is disposed between the sides of the two support rods (13) adjacent to the pivot joint end; two distal ends of the said elastic element (14) respectively joint the said support rods (13); a pair of steel wires (15) extending downward are symmetrically disposed on the sides of the said support rods (13) adjacent to the said elastic element (14); the distal ends of the said steel wires (15) connect with the inner edge of a support body (16) on the bottom edge of the said golf bag (1); one end of the said support body (16) is pivotally disposed on the bottom edge of the said golf bag (1); a positioning element (151) is sleeved on between the said steel wires (15); when in use, the said support rods (13) are spread outward; by standing on a plane at a certain angle, the said support rods (13) and the support body (16) enable the golf bag (1) to stand on the said plane.

However, the surface of the said steel wires (15) are covered only by two ends of the said positioning element (151) in order to fix and prevent the said support rods (13) from further expanding outward; the strength of the said positioning element (15) covering on the said steel wires (15) is limited; after a certain usage time, the said positioning element (151) tends to slide down and that causes the said support rods (13) to expand outward and thereby makes the golf bag (1) unable to stably stand on the said plane; furthermore, the said steel wires (15) exposing outside the surface of the golf bag (1) may easily be bumped and damaged.

In view of the mentioned situation, in order to improve the shortcomings of the said conventional golf bag support apparatus, the inventor of the present invention, following long-term diligent researches and experiments, finally culminated in the development and design of the present invention of a golf bag support apparatus.

SUMMARY OF THE INVENTION

Therefore, the primary objective of the present invention is to provide a golf bag support apparatus with a pair of support rods extending downward and symmetrically disposed on the opening side rim of the said golf bag; a pair of steel wires are symmetrically disposed at one end of the opening where the said support rods are adjacent to the golf bag; the said steel wires go through an opening near the central area of the golf bag, extend downward to the bottom edge of the golf bag along the inner edge thereof, go through another opening of the said bottom edge and protrude the golf bag; a positioning element is disposed on the circumferential rim of the said opening; a support body is pivotally disposed at one distal end of the said steel wires penetrated the bottom edge of the golf bag; when the said support rods are spread to stand on a plane, the specialty of not easily slipping of the said steel wires pressing against onto the positioning element enables the said support rods and the support body to position respectively and stably at an expanded angle, thereby makes the golf bag stand on the said plane without sliding down.

To enable a further understanding of the object, the shape, the features of the structure and the device as well as the efficiency thereof, the brief description of the drawings below is followed by the detailed description of the preferred embodiment.

DETAILED DESCRIPTION OF THE PREFERRED EMBODIMENTS

Figure 1:
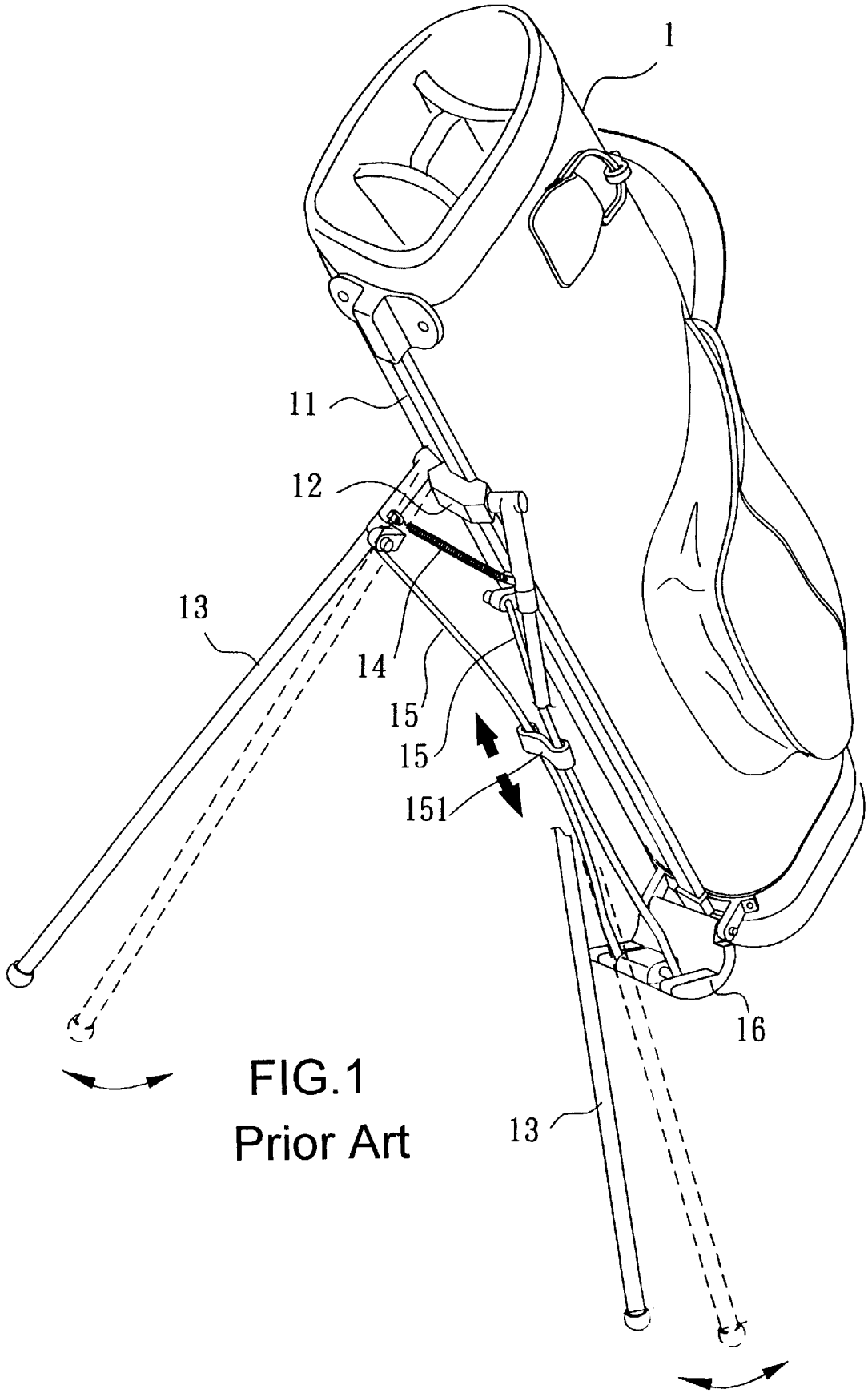
FIG.1 Prior Art
FIG. 1 is a pictorial and external view drawing of a conventional design.
Figure 2:
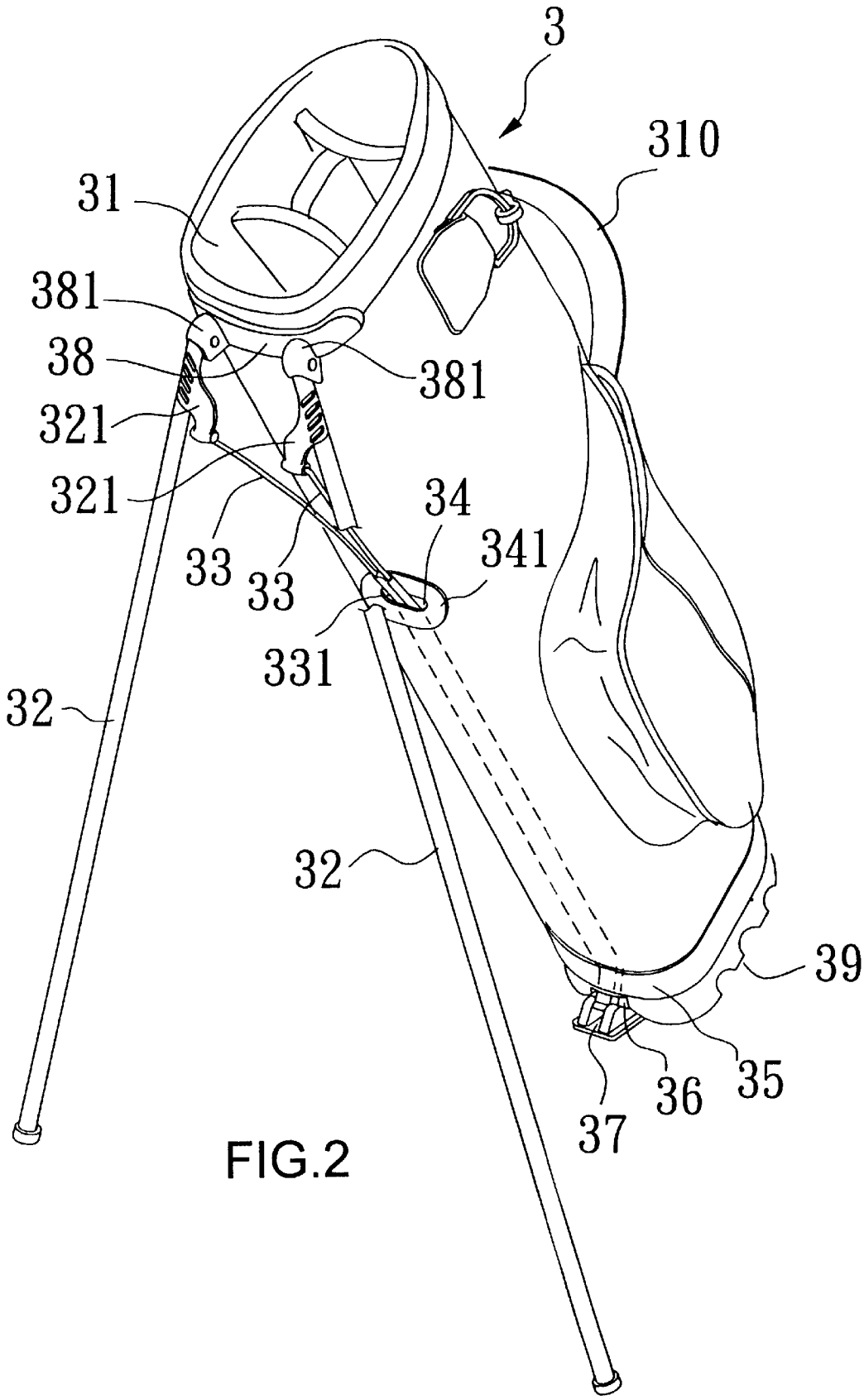
FIG. 2 is a pictorial and external view drawing of the present invention.
Figure 4:
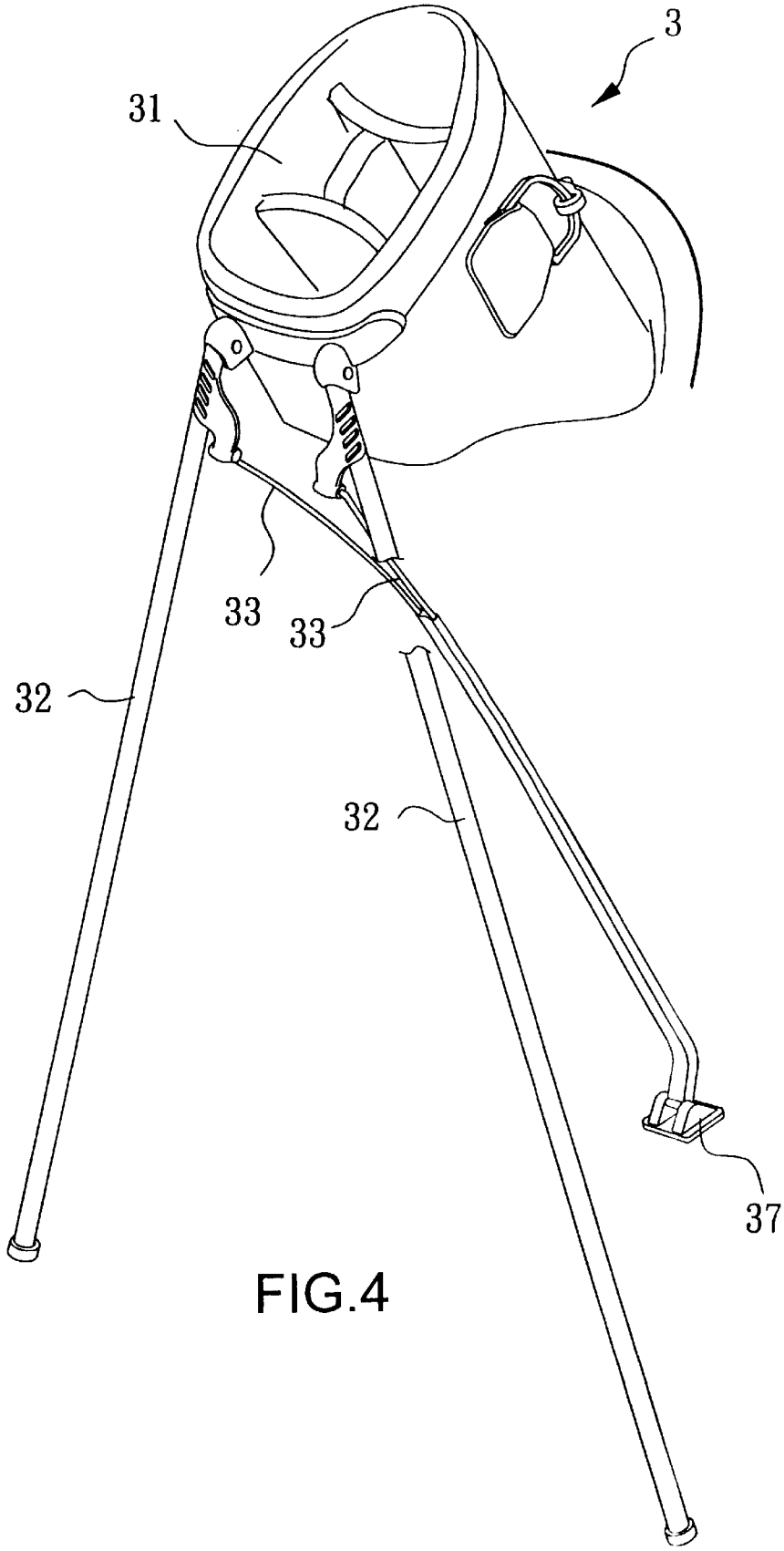
FIG. 4 is a schematic drawing of the support rods and the support body of the present invention respectively standing on a plane.

The present invention is a golf bag support apparatus, referring to FIGS. 2 and 4, a pair of support rods (32) extending downward are symmetrically disposed on the opening (31) side rim of the said golf bag (3); a pair of steel wires (33) are symmetrically disposed at one end of the opening (31) where the said support rods (32) are adjacent to the golf bag (3); the said steel wires (33) go through an opening (34) near the central area of the golf bag (3), extend downward to the bottom edge (35) of the golf bag (3) along the inner edge thereof, go through another opening (36) of the said bottom edge (35) and protrude the golf bag (3); a positioning element (341) is disposed on the circumferential rim of the said opening (34); a support body (37) is pivotally disposed at one distal end of the said steel wires (33) penetrated the bottom edge (35) of the golf bag (3); when the said support rods (32) are spread to stand on a plane, the specialty of not easily slipping of the said steel wires (33) pressing against onto the positioning element (341) enables the said support rods (32) and the support body (37) to position respectively and stably at an expanded angle, as shown in FIG. 4, thereby makes the golf bag (3) stand on the said plane without sliding down.

Figure 3:
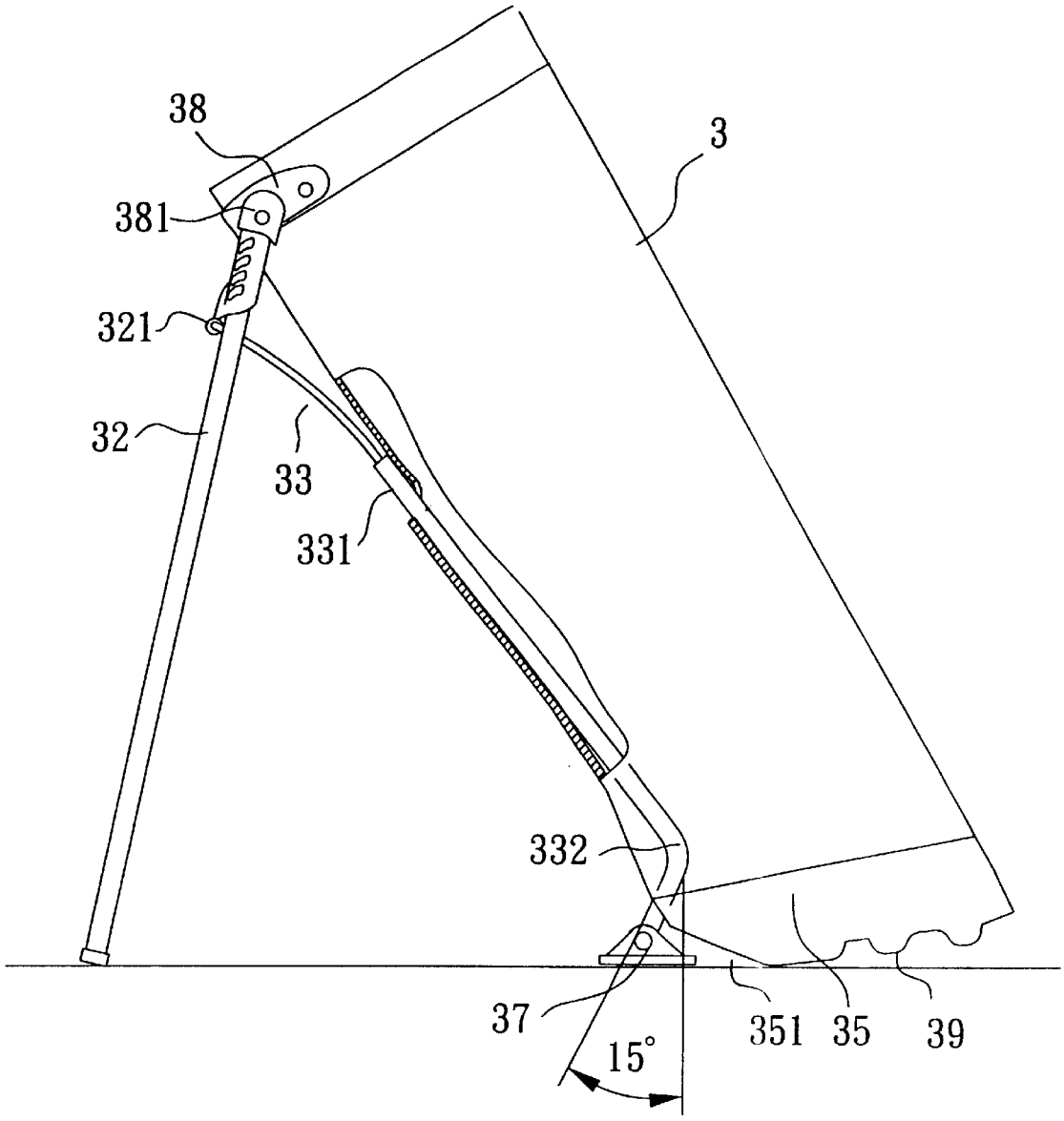
FIG. 3 is a lateral view and plane drawing of the present invention.

According to the present invention, referring to FIGS. 2 and 3, a fixed plate (38) is disposed between the said golf bag (3) and the support rods (32); the said fixed plate (38) is fixed to the side rim of the golf bag (3); the said support rods (32) are pivotally disposed on a pair of protruding bodies (381) of the said fixed plate (38); a pair of connecting bodies (321) are disposed between the support rods (32) and the said steel wires (33); a layer of fixed body (331) covers over the other end surface of the said steel wires (33) relative to the support rods (32) for binding the steel wires (33) at the said end together to increase the strength thereof; a bent angle (332) of 15 degree is disposed at the bottom end of the said steel wires (33); the said bent angle (332) facilitates the golf bag (3) to stand on a plane.

According to the present invention, referring to FIGS. 2 and 3, the said golf bag (3) has a tooth-shaped bottom plane (39); a certain inclined angle (391), such as a bevel angle of 35 degree, is disposed at the position on the said bottom plane (39) relative to the support body (37); furthermore, a lift handle (310) is disposed on the golf bag (3).

By virtue of the assembly of the mentioned members, when the said support rods (32) are spread to stand on a plane, the specialty of not easily slipping of the said steel wires (33) pressing against onto the positioning element (341) enables the said support rods (32) and the support body (37) to position respectively and stably at an expanded angle, as shown in FIG. 4, thereby makes the golf bag (3) stand on the said plane without sliding down; at the same time, the said steel wires (15) do not expose outside the surface of the golf bag (1) and thereby will not be bumped easily and damaged.

The foregoing example is only the best exemplary embodiment of the present invention, however, the structural feature of the present invention is not limited herein; any change or modification made by those skilled in the art and within the scope of the present invention should be included in the scope of the claim application of the present invention.

What is claimed is:

1. A golf bag support apparatus comprising a golf bag having an upper opening side rim, a first opening in a central area and a second opening at a lower portion;

a pair of support rods pivotally mounted to the golf bag adjacent to the upper opening side rim;

a positioning element mounted around the first opening;

a pair of steel wires, each having a first end pivotally connected to one of the pair of support rods, the steel wires passing through the first opening so as to press against the positioning element, the steel wires having second ends extending exteriorly of the golf bag through the second opening; and, a support body, pivotally mounted solely on the second ends of the steel wires so as to be separate from a bottom of the golf bag.

2. The golf bag support apparatus according to claim 1, further comprising a fixed plate attached to the golf bag and pivotally connected to the support rods, the fixed plate being fixed to the upper opening side rim of the golf bag.

3. The golf bag support apparatus according to claim 1, further comprising a pair of connecting bodies connecting the first ends of the pair of steel wires to the support rod.

4. The golf bag support apparatus according to claim 1, further comprising a cover layer binding the steel wires together along a portion of their lengths.

5. The golf bag support apparatus according to claim 1, wherein the second ends of the pair of steel wires are bent at an angle of 15 degrees relative to adjacent portions of the steel wires.

6. The golf bag support apparatus according to claim 1, wherein, the golf bag further comprises a tooth-shaped bottom.

7. The golf bag support apparatus according to claim 6, wherein, the tooth-shaped bottom includes a beveled portion.

8. The golf bag support apparatus according to claim 1, further comprising a lift handle on the golf bag.

* * * * *